US006067981A

United States Patent [19]

Peter et al.

[11] Patent Number: 6,067,981

[45] Date of Patent: May 30, 2000

[54] PARTIAL WIDTH OVEN RACK

[75] Inventors: Russ Brian Peter, Grinnell, Iowa; John Scott Brown, Charleston, Tenn.

[73] Assignee: Maytag Corporation, Newton, Iowa

[21] Appl. No.: 08/905,726

[22] Filed: Aug. 4, 1997

[51] Int. Cl.[7] ..... F24C 15/16

[52] U.S. Cl. ..... 126/337 R; 126/337 A; 126/333; 211/150; 211/153; 99/393; 99/402

[58] Field of Search ..... 126/339, 332, 126/337 A, 337 R, 333, 41 R, 25 R, 505, 506; 99/448, 393, 402, 445, 446; 211/181.1, 90.01, 90.02, 90.03, 150, 153

[56] References Cited

U.S. PATENT DOCUMENTS

| | | | |
|---|---|---|---|
| 618,499 | 1/1899 | Edwards | 126/337 R |
| 1,896,307 | 2/1933 | Hatch | 126/339 |
| 1,983,110 | 12/1934 | Warrick | 126/337 A |
| 2,002,339 | 5/1935 | Copeman | 126/337 R |
| 2,421,922 | 6/1947 | Bocchino | 99/449 |
| 2,446,391 | 8/1948 | Reeves . | |
| 2,614,483 | 10/1952 | Scofield | 126/337 R |
| 3,053,245 | 9/1962 | Beller | 126/25 R |
| 3,169,520 | 2/1965 | Smith et al. | 126/338 |
| 3,244,163 | 4/1966 | McGlaughlin | 126/25 R |
| 3,266,484 | 8/1966 | Carpenter et al. | 126/337 R |
| 3,489,136 | 1/1970 | Bucellato | 126/337 R |
| 3,789,826 | 2/1974 | Baltz et al. | 126/339 |
| 3,792,654 | 2/1974 | Turner | 99/447 |
| 3,967,613 | 7/1976 | Rybak et al. | 126/41 R |
| 3,976,000 | 8/1976 | Oxel | 99/393 |
| 4,127,099 | 11/1978 | Fortier | 126/505 |
| 4,233,890 | 11/1980 | Jansen | 99/448 |
| 4,628,896 | 12/1986 | Baynes | 126/25 R |
| 4,685,575 | 8/1987 | Kulbersh | 211/153 |
| 4,942,862 | 7/1990 | Alden et al. | 126/337 R |
| 5,069,196 | 12/1991 | Schlosser et al. | 126/337 R |
| 5,528,984 | 6/1996 | Saurwein | 126/25 R |

*Primary Examiner*—Ira S. Lazarus
*Assistant Examiner*—Josiah C. Cocks
*Attorney, Agent, or Firm*—Everett G. Diedericks, Jr.

[57] ABSTRACT

An oven cavity, having an associated width defined by a lateral distance spanning side walls thereof, is provided with an oven rack that has a maximum lateral dimension which is substantially less than the width of the oven cavity and is directly supported by the oven cavity. In accordance with the preferred embodiment of the invention, the oven rack includes a platform portion, as well as first and second support portions. The first support portion is attached to a rear wall of the cavity and the second support portion is adapted to engage a runner provided on one of the side walls of the cavity, at least when the platform portion is weighted down by an item to be cooked. In the preferred embodiment, the first support portion projects rearwardly and upwardly from the platform portion and has an uppermost section provided with a pair of spaced retaining clips that are received within lanced tabs formed in the rear wall of the oven cavity. A lower section of the first support portion actually extends rearward of the retaining clips and abuts the rear wall to maintain the second support portion in an elevated state above the side wall runner until an item to be cooked is placed upon the platform portion, at which time, the lower section is placed under compression. In further accordance with the preferred embodiment, the second support portion projects laterally outwardly of the platform portion such that the platform portion is spaced from a respective side wall of the oven cavity.

28 Claims, 3 Drawing Sheets

PARTIAL WIDTH OVEN RACK

BACKGROUND OF THE INVENTION

1. Field of the Invention

The present invention pertains to the art of cooking appliances and, more particularly, to a rack that is mounted within an oven cavity wherein the rack has a maximum lateral dimension which is substantially less than the width of the oven cavity and is directly supported by the oven cavity.

2. Discussion of the Prior Art

Ovens designed for household use in today's marketplace are generally provided with multiple elongated racks, each of which has a lateral dimension substantially equal to the width of the oven cavity in which it is adapted to be placed for supporting items to be cooked. The cavity itself is generally provided with side wall runners for supporting respective lateral ends of the racks and permitting vertical adjustability of the racks.

It is often the case that multiple items need to be cooked simultaneously within an oven and the height of at least one of the items is such that only a single rack can be accommodated within the oven cavity. In other words, even if the two racks are spaced vertically a maximum permissible distance within the oven cavity, the item to be cooked could not be placed upon the lower rack due to interference by the upper rack. Under such circumstances, the upper rack must be entirely removed from the oven cavity, thereby leaving only the single rack to support each of the items to be cooked. Unfortunately, this obviously limits the available supporting area for the various items to be cooked.

For this and other reasons, it has been proposed in the art to mount additional food support structure, which does not extend entirely across the width of the oven cavity, from the elongated rack itself. An example of such an apparatus is the broiler system disclosed in U.S. Pat. No. 3,266,484. Unfortunately, such an arrangement has various associated drawbacks. For instance, suspending a partial width food support structure beneath an elongated rack requires that the rack be placed at a substantially high elevational position within the oven cavity. This is undesirable, particularly for baking purposes, where it is desirable to have the majority of the cooking surface at a lower position. Another drawback is that the partial width food support structure is always moved relative to the oven cavity commensurate with the elongated rack. Therefore, the elongated rack cannot be repositioned without simultaneously repositioning the partial width food support structure and vise-versa. In addition, as many known elongated racks are slidably mounted within oven cavities, the additional weight of the partial width food support structure and the items to be cooked thereon makes sliding of the elongated rack more difficult and potentially hazardous as the potential for movement of multiple items being cooked must be accounted for.

Based on the above, there exists a need in the art for a partial width food support arrangement for use in an oven cavity which does not exhibit the drawbacks associated with the known prior art. Therefore, it is an object of the present invention to provide a rack for use in the cavity of an oven wherein the rack has a maximum lateral dimension which is substantially less than the width of the oven cavity. It is also an object of the invention to provide a partial width oven rack that is directly supported by the oven cavity, independent of any other food item supporting rack positioned in the cavity.

SUMMARY OF THE INVENTION

The foregoing objects are achieved by providing an oven rack having a maximum lateral dimension which is substantially less than the width of the oven cavity which directly supports the rack. In the preferred embodiment, the partial width oven rack includes a platform portion and first and second support portions, with the first support portion extending upwardly and rearwardly from the platform portion and being connected to a rear wall of the oven cavity. In the most preferred form of the invention, the first support portion is provided with a pair of laterally spaced retaining clips which are received in slots defined by lanced tabs created in the rear wall of the oven cavity. The second support portion preferably includes a lateral extension of the platform portion with the extension being adapted to be engaged with a respective runner formed on a side wall of the oven cavity. The first support portion also includes a section which abuts the rear wall such that the second support portion is suspended above the runner when the platform is not weighted down by an item to be cooked and, when the platform is weighted down, the second support portion is brought into engagement with the runner. At the same time, the section of the first support portion that abuts the rear wall is placed under compression to enhance the interengagement between the rack and the oven cavity.

Given that the partial width oven rack of the present invention is not connected to or supported from any other rack placed in the oven cavity, the partial width oven rack can be separately inserted or removed from the oven cavity. In addition, since the oven rack of the present invention only extends across part of the width of the oven cavity, the placement of an elongated rack therebelow enables the consumer to readily use large roasters or pots on one side of the oven cavity, while still being able to cook in other pans or pots on the other side of the oven cavity in a desirable cooking position.

Additional objects, features and advantages of the present invention will become readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
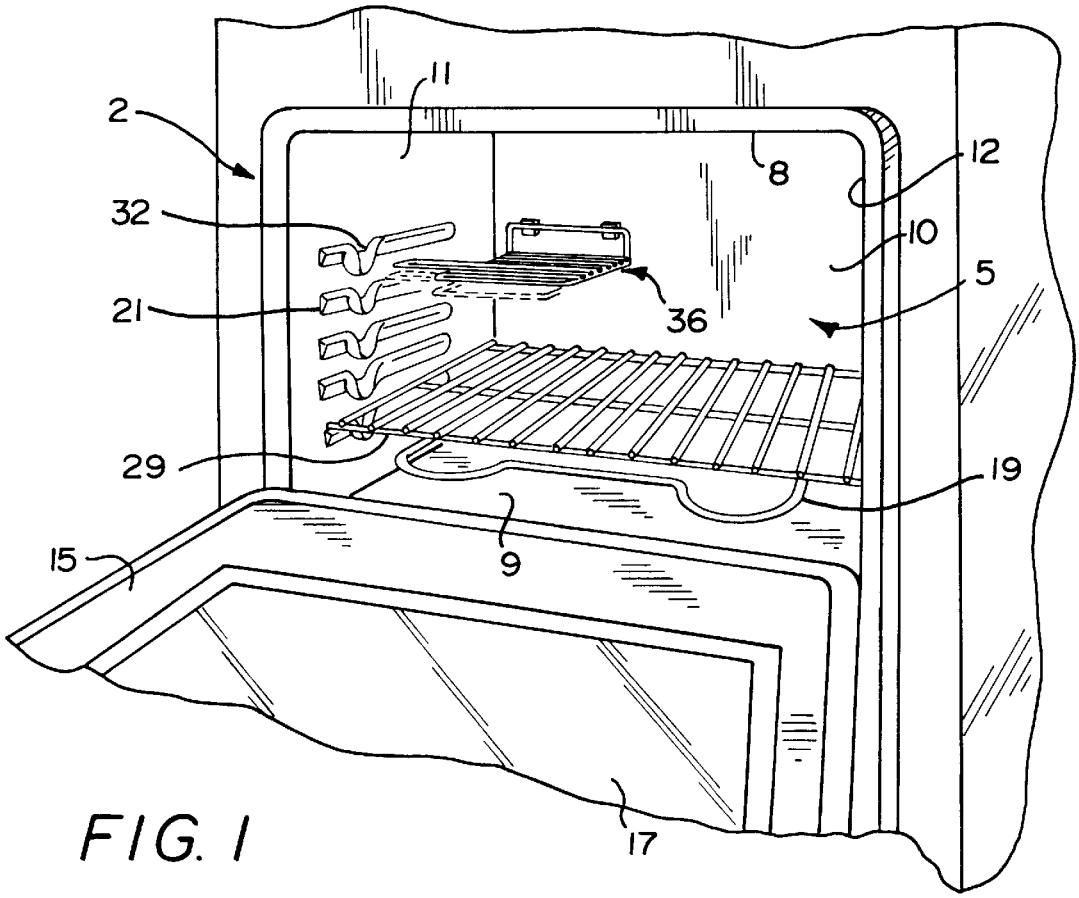
FIG. 1 is a partial perspective view of an oven incorporating the partial width rack of the present invention.
Figure 2:
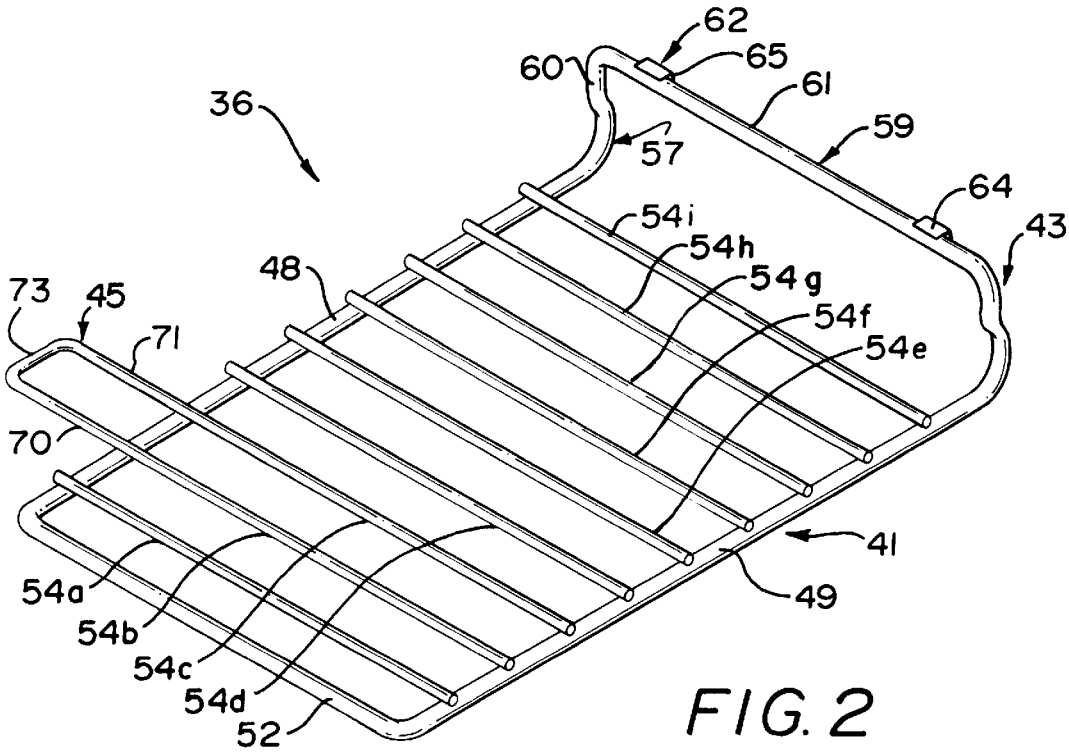
FIG. 2 is a perspective view of the partial width oven rack in accordance with a preferred embodiment thereof.
Figure 3:
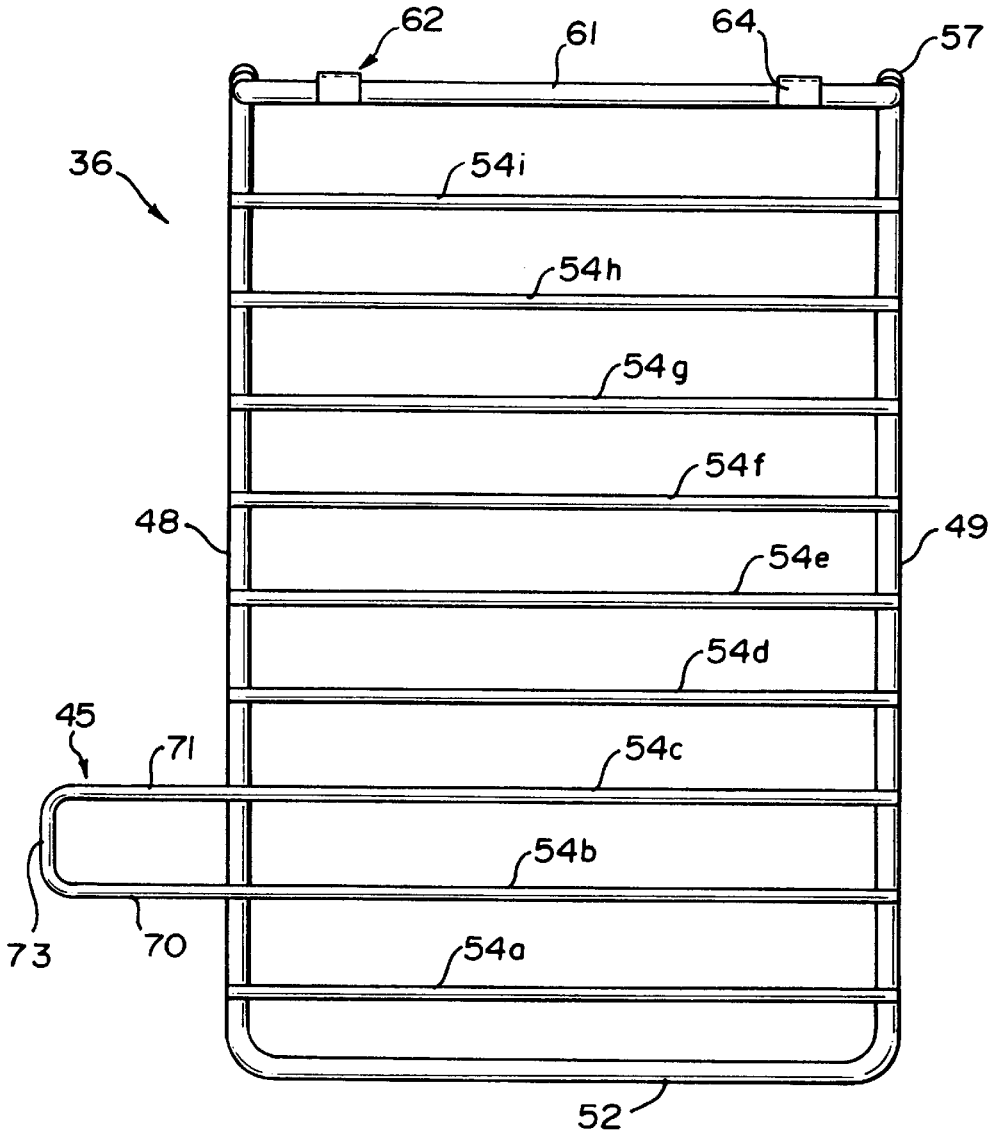
FIG. 3 is a top view of the oven rack of FIG. 2.
Figure 4:
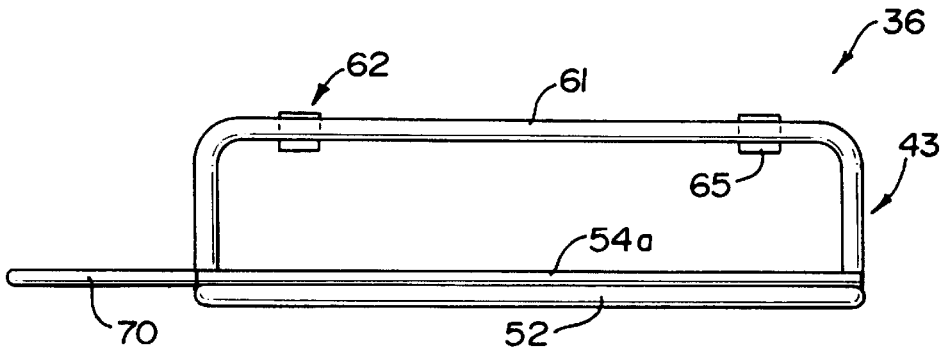
FIG. 4 is a front elevational view of the oven rack of FIG. 2.

With initial reference to FIG. 1, an oven associated with the present invention is generally indicated at 2. In a manner known in the art, oven 2 includes a cavity 5 defined by top, bottom, rear and side walls 8–12 respectively. Cavity 5 is adapted to be closed by means of a door 15 that is illustrated to include a tempered glass section 17. Although various types of heating sources can be utilized in connection with oven 2, in the preferred embodiment shown, an electric heating element 19 is provided adjacent bottom 9 and a similar element (not shown) is provided adjacent top 8 for broiling purposes.

In a manner also known in the art, side walls 11 and 12 are preferably provided with a plurality of fore-to-aft extending and vertically spaced runners, one of which is indicated at 21. Each of the runners 21 are arranged as associated pairs on the side walls 11 and 12 in order to support an elongated rack 29 that extends across substantially the entire width of cavity 5. Of course, elongated rack 29 can be supported upon any respective pair of the runners 21 such that elongated rack 29 can assume various vertical positions within cavity 5. Each of the runners 21 preferably includes a detent portion 32 that cooperates with a tab or the like (not labeled) provided on elongated rack 29 in order to limit the movement of rack 29 relative to cavity 5. As the mounting of rack 29 within cavity 5 is not considered part of the present invention, it will not be discussed further herein. Instead, the present invention is directed to a partial width oven rack which is generally indicated at 36 in FIG. 1.

Reference now will be made to FIGS. 2–6 in describing the preferred construction of partial width oven rack 36. As shown in these figures, oven rack 36 is preferably constructed of metal wire, such an iron coated with nickel, but it should be realized that other constructions are possible within the scope of the invention, including making the entire rack out of sheet metal. In any event, oven rack 36 is provided with a platform portion 41, a first support portion 43 and a second support portion 45. In the preferred embodiment shown, platform portion 41 includes a pair of laterally spaced and generally parallel arranged sidebars 48 and 49 which are interconnected by a front crossbar 52, as well as a plurality of fore-to-aft spaced and laterally extending wire rails 54*a*–54*i*. In the most preferred form, each of the wire rails 54*a*–54*i* is welded to sidebars 48 and 49.

Figure 5:
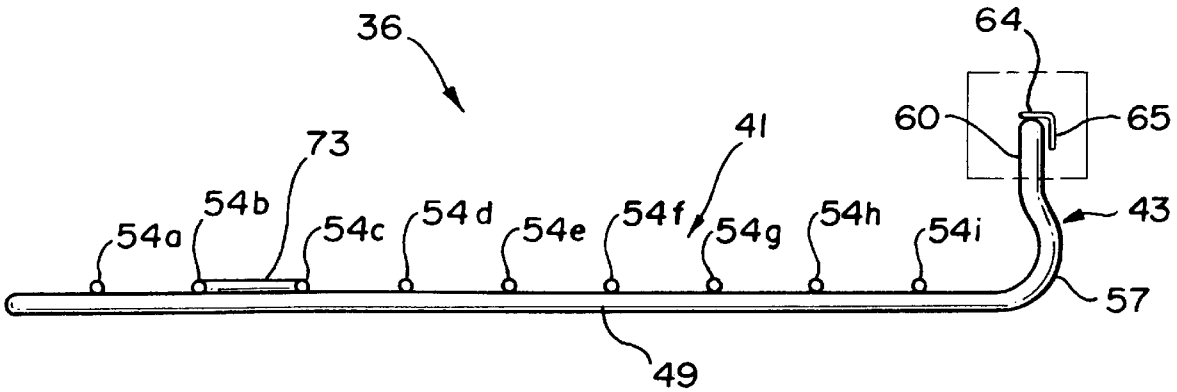
FIG. 5 is a side elevational view of the oven rack of FIG. 2.
Figure 6:
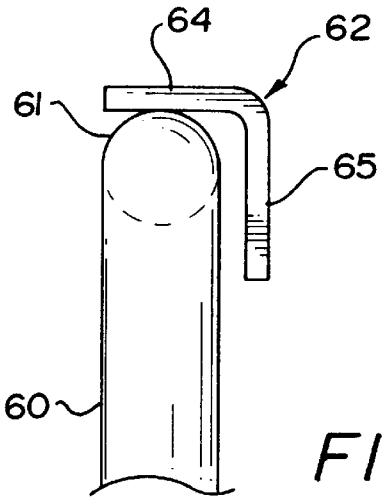
FIG. 6 is an enlarged view of a portion of the oven rack depicted in FIG. 5.

First support portion 43 includes a first section 57, which projects rearwardly and upwardly from rear end portions of each of the sidebars 48 and 49, and a second section 59, which includes first upright portion 60 and a crosspiece 61. As perhaps best shown in FIG. 5, first section 57 is preferably arcuate in shape and projects rearward beyond that of second section 59. The advantages of this preferred construction will become more fully evident below. Connected to crosspiece 61 is a pair of laterally spaced retaining clips 62. Each retaining clip 62 is preferably, generally L-shaped in side-view, as best shown in FIGS. 5 and 6, such that each retaining clip 62 includes a first leg 64 that is secured to crosspiece 61, such as through a welding process, and a second leg 65 that extends downwardly and which is positioned slightly rearward of first section 57. However, as also clearly illustrated in FIG. 5, each leg 65 is also preferably arranged slightly forward of the rearwardmost portion of first section 57.

In the preferred embodiment shown, second support portion 45 projects laterally outwardly of side bar 48. More particularly, second support portion 45 is formed by providing rail extensions 70 and 71 for wire rails 54*b* and 54*c* and joining the rail extensions 70 and 71 by connection section 73. Actually, the preferred embodiment has wire rails 54*b* and 54*c*, rail extensions 70 and 71 and connection section 73 formed by bending a single piece of wire into a generally U-shape. In any event, it is simply important to note that, in the preferred embodiment, second support portion 45 projects laterally outwardly of platform portion 41. Again, the reason for this arrangement will become more fully evident below.

Figure 7:
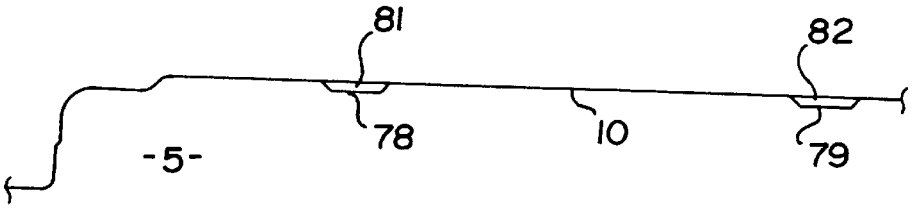
FIG. 7 is a partial, cross-sectional view of a rear portion of the oven shown in FIG. 1.

For use in mounting oven rack 36 within cavity 5 in accordance with the preferred embodiment of the invention, rear wall 10 of cavity 5 is formed with a pair of tabs 78 and 79 that define slots 81 and 82 as best shown in FIG. 7. Although various arrangements can be utilized to provide such tabs 78 and 79 on rear wall 10, since cavity 5 is preferably formed from sheet metal, tabs 78 and 79 can be economically and easily formed as lanced tabs. With this construction, each of the slots 81 and 82 is adapted to receive a leg 65 of a respective retaining clip 62 when mounting partial width oven rack 36 within cavity 5. More specifically, partial width oven rack 36 is preferably mounted in cavity 5 by initially angling oven rack 36 with respect to a horizontal while positioning second support portion 45 between a pair of upper and lower runners as best shown in FIG. 1. With this angling, the retaining clip 62 located closest to side wall 11 can be easily positioned within slot 81 and then oven rack 36 can be rotated such that leg 65 of the other retaining clip 62 is received within slot 82.

When oven rack 36 is unweighted, i.e., platform portion 41 is not weighted down by an item to be cooked, second support portion 45 is preferably suspended between the upper and lower runners 21 as indicated by the solid lines in FIG. 1. At this point, oven rack 36 is simply supported at rear wall 10 by the interconnection between retaining clip 62 and tabs 78 and 79, as well as the abutment of first section 57 of first support portion 43 with rear wall 10. This configuration is specifically enabled with the preferred construction of oven rack 36 and, more particularly, due to the fact that second section 59 and retaining clips 62 are located forward of the rearwardmost portion of first section 57 of first support portion 43. Therefore, in this non-weighted position, platform portion 41 slopes slightly upwardly from adjacent rearwall 10. However, when an item such as a pie or the like is placed upon platform portion 41, platform portion 41 will shift downwardly such that second support portion 45 engages a respective lower runner 21. In this weighted position, it should be readily apparent that at least a portion of first section 57 is placed under compression. This arrangement is preferred since it has been found to prevent retaining clips 62 from being inadvertently dislodged from within slots 81 and 82.

In accordance with the preferred embodiment of the invention, partial width oven rack 36 extends no more than half the width of cavity 5 and, preferably, in the order of one quarter to one-third the width. This arrangement enables more efficient utilization of the cooking space within cavity 5. More specifically, since oven rack 36 only extends partially across the width of cavity 5, a pot or other cooking item that has a height greater than the distance between racks 29 and 36 can still be positioned upon rack 29 within cavity 5 at a location offset from rack 36, while a second item to be cooked can be placed upon rack 36. If desired, additional tabs or other connectors can be attached to rear wall 10 that will still enable oven rack 36 to be directed supported by cavity 5, but yet will enable some vertical adjustability for oven rack 36. Since second support portion 45 projects laterally of platform portion 41 in the preferred embodiment, a space is provided between side wall 11 and platform portion 41 which will assure that the item to be cooked upon rack 36 is not placed in direct abutment with side wall 11 and that some clearance is available to aid in removal of the item, either alone or simultaneously with oven rack 36.

Although described with respect to a preferred embodiment of the invention, it should be readily understood that various changes and/or modifications can be made to the present invention without departing from the spirit thereof.

Therefore, the particular construction of oven rack 36 can vary so long as the maximum lateral dimension thereof is substantially less than the width of oven cavity 5 and the particular support arrangement can also vary while still assuring that the oven rack 36 is supported by oven cavity 5 itself. In any event, the invention is only intended to be limited by the scope of the following claims.

We claim:

1. In an appliance including an oven cavity formed from top, bottom, rear and side walls, with the oven cavity having an open frontal portion and an associated width defined by a lateral distance spanning the side walls, with the appliance further including a door pivotally mounted for selectively closing off the open frontal portion, an oven rack comprising a maximum lateral dimension which is substantially less than the width of the oven cavity, said oven rack being positioned in and directly supported against downward vertical displacement solely at one or more of the rear wall and a single one of the side walls of the oven cavity, wherein the oven rack includes a platform portion, upon which an item to be cooked is adapted to be placed, a first support portion, with the first support portion being attached to the rear wall of the oven cavity, and a second support portion, said oven cavity being formed with a plurality of vertically spaced runners arranged on each of the side walls, said second support portion being movable between a non-weighted position, wherein the second support portion is positioned between a pair of vertically adjacent upper and lower runners of the plurality of vertically spaced runners on one of the side walls and above the lower runner, and a weighted position, wherein the second support portion engages the lower runner.

2. In an appliance including an oven cavity formed from top, bottom, rear and side walls, with the oven cavity having an open frontal portion and an associated width defined by a lateral distance spanning the side walls, with the appliance further including a door pivotally mounted for selectively closing off the open frontal portion, an oven rack comprising a maximum lateral dimension which is substantially less than the width of the oven cavity, said oven rack being positioned in and directly supported against downward vertical displacement solely at one or more of the rear wall and a single one of the side walls of the oven cavity, wherein the oven rack includes a platform portion, upon which an item to be cooked is adapted to be placed, and a first support portion, with the first support portion being attached to the rear wall of the oven cavity, said first support portion including a pair of laterally spaced retaining clips for attaching the oven rack to the rear wall of the oven cavity.

3. In an appliance including an oven cavity formed from top, bottom, rear and side walls, with the oven cavity having an open frontal portion and an associated width defined by a lateral distance spanning the side walls, with the appliance further including a door pivotally mounted for selectively closing off the open frontal portion, an oven rack comprising a maximum lateral dimension which is substantially less than the width of the oven cavity, said oven rack being positioned in and directly supported against downward vertical displacement solely at one or more of the rear wall and a single one of the side walls of the oven cavity, said oven rack including a platform portion, upon which an item to be cooked is adapted to be placed, and a first support portion, with the first support portion being attached to the rear wall of the oven cavity, said first support portion projecting above the platform portion within the oven cavity.

4. The oven rack according to claim 3, wherein the first support portion includes a pair of laterally spaced retaining clips for attaching the oven rack to the rear wall of the oven cavity.

5. The oven rack according to claim 4, wherein the rear wall of the oven cavity is formed with a pair of laterally spaced, tab forming slots which receive the retaining clips.

6. The oven rack according to claim 4, wherein the first support portion includes a first section that extends upwardly and rearwardly from the platform portion and a second section, projecting above the first section, provided with the spaced retaining clips.

7. The oven rack according to claim 6, wherein the first section of the first support portion abuts the rear wall of the oven cavity and at least a portion of the first section is placed in compression when the platform portion is weighted down by an item to be cooked.

8. The oven rack according to claim 2, wherein the oven cavity is formed with a plurality of vertically spaced runners arranged on each of the side walls and the oven rack further comprises a second support portion positioned between two vertically adjacent runners on one of the side walls.

9. The oven rack according to claim 8, wherein the second support portion projects laterally outwardly of the platform portion such that the platform portion is spaced from each of the side walls.

10. The oven rack according to claim 9, wherein the platform portion is formed by a plurality of fore-to-aft spaced and laterally extending wire rails and the second support portion is defined by an extension section of at least two of the rails which are interconnected at a position located laterally outwardly of the platform portion.

11. The oven rack according to claim 9, wherein the second support portion is movable between a non-weighted position, wherein the second support portion is arranged between a pair of adjacent upper and lower runners and above the lower runner, and a weighted position, wherein the second support portion engages the lower runner.

12. In an appliance including an oven cavity formed from top, bottom, rear and side walls, with the oven cavity having an open frontal portion and an associated width defined by a lateral distance spanning the side walls, with the appliance further including a door pivotally mounted for selectively closing off the open frontal portion, an oven rack comprising a maximum lateral dimension which is substantially less than the width of the oven cavity, said oven rack including a platform portion, upon which an item to be cooked is adapted to be placed, and a first support portion, the first support portion being connected to the oven cavity at the rear wall to prevent undesired downward vertical displacement of the oven rack relative to the oven cavity at the rear wall, wherein the first support portion projects above the platform portion within the oven cavity.

13. In an appliance including an oven cavity formed from top, bottom, rear, and side walls, with the oven cavity having an open frontal portion and an associated width defined by a lateral distance spanning the side walls, with the appliance further including a door pivotally mounted for selectively closing off the open frontal portion, an oven rack comprising a maximum lateral dimension which is substantially less than the width of the oven cavity, said oven rack including a platform portion, upon which an item to be cooked is adapted to be placed, and a first support portion, the first support portion being connected to the oven cavity at the rear wall to prevent undesired downward vertical displacement of the oven rack relative to the oven cavity at the rear wall, wherein the first support portion includes a pair of laterally spaced retaining clips for attaching the oven rack to the rear wall of the oven cavity.

14. The oven rack according to claim 13, wherein the rear wall of the oven cavity is formed with a pair of laterally spaced, tab forming slots which receive the retaining clips.

15. The oven rack according to claim 14, wherein the first support portion includes a first section that extends upwardly and rearwardly from the platform portion and a second section, projecting above the first section, provided with the spaced retaining clips and wherein the first section of the first support portion abuts the rear wall of the oven cavity and at least a portion of the first section is placed in compression when the platform portion is weighted down by an item to be cooked.

16. The oven rack according to claim 12, wherein the oven cavity is formed with a plurality of vertically spaced runners arranged on each of the side walls and the oven rack further comprises a second support portion positioned between two vertically adjacent runners on one of the side walls.

17. The oven rack according to claim 16, wherein the second support portion projects laterally outwardly of the platform portion such that the platform portion is spaced from each of the side walls.

18. The oven rack according to claim 17, wherein the platform portion is formed by a plurality of fore-to-aft spaced and laterally extending wire rails and the second support portion is defined by an extension section of at least two of the rails which are interconnected at a position located laterally outwardly of the platform portion.

19. The oven rack according to claim 17, wherein the second support portion is movable between a non-weighted position, wherein the second support portion is arranged between a pair of adjacent upper and lower runners and above the lower runner, and a weighted position, wherein the second support portion engages the lower runner.

20. In an appliance including an oven cavity formed from top, bottom, rear and side walls, with the oven cavity having an associated width defined by a lateral distance spanning the side walls, an oven rack comprising a maximum lateral dimension which is substantially less than the width of the oven cavity, said oven rack being positioned in and directly supported by the oven cavity, wherein the oven rack includes a platform portion, upon which an item to be cooked is adapted to be placed, and a first support portion, with the oven rack being supported against undesired downward vertical displacement relative to the oven cavity at the rear wall through an attachment of the first support portion to the rear wall of the oven cavity, wherein the first support portion projects above the platform portion within the oven cavity.

21. The oven rack according to claim 20, wherein the first support portion includes a pair of laterally spaced retaining clips for attaching the oven rack to the rear wall of the oven cavity.

22. The oven rack according to claim 21, wherein the rear wall of the oven cavity is formed with a pair of laterally spaced, tab forming slots which receive the retaining clips.

23. The oven rack according to claim 21, wherein the first support portion includes a first section that extends upwardly and rearwardly from the platform portion and a second section, projecting above the first section, provided with the spaced retaining clips.

24. The oven rack according to claim 23, wherein the first section of the first support portion abuts the rear wall of the oven cavity and at least a portion of the first section is placed in compression when the platform portion is weighted down by an item to be cooked.

25. The oven rack according to claim 20, wherein the oven cavity is formed with a plurality of vertically spaced runners arranged on each of the side walls and the oven rack further comprises a second support portion positioned between two vertically adjacent runners on one of the side walls.

26. The oven rack according to claim 25, wherein the second support portion projects laterally outwardly of the platform portion such that the platform portion is spaced from each of the side walls.

27. The oven rack according to claim 26, wherein the platform portion is formed by a plurality of fore-to-aft spaced and laterally extending wire rails and the second support portion is defined by an extension section of at least two of the rails which are interconnected at a position located laterally outwardly of the platform portion.

28. The oven rack according to claim 26, wherein the second support portion is movable between a non-weighted position, wherein the second support portion is arranged between a pair of adjacent upper and lower runners and above the lower runner, and a weighted position, wherein the second support portion engages the lower runner.

* * * * *